United States Patent [19]

Chiaro et al.

[11] Patent Number: 4,755,000

[45] Date of Patent: Jul. 5, 1988

[54] SEAT WITH REMOVABLE CUSHIONS

[75] Inventors: Michael T. Chiaro; Henry J. Weaver, both of York, Pa.

[73] Assignee: Shelby Williams Industries, Inc., Chicago, Ill.

[21] Appl. No.: 947,228

[22] Filed: Dec. 29, 1986

[51] Int. Cl.[4] ..... A47C 4/02

[52] U.S. Cl. ..... 297/440; 297/443; 297/455

[58] Field of Search ..... 297/440, 218, 223, 283, 297/443, 455, 456, 441, 442

[56] References Cited

U.S. PATENT DOCUMENTS

| | | | |
|---|---|---|---|
| 2,837,144 | 6/1958 | Heller | 297/456 X |
| 3,874,729 | 4/1975 | Blodee | 297/440 X |
| 3,989,300 | 11/1976 | Heumann | 297/440 |
| 4,199,189 | 4/1980 | Neumann | 297/440 X |
| 4,395,071 | 7/1983 | Laird | 297/440 |
| 4,488,755 | 12/1984 | Nemschoff | 297/283 X |
| 4,492,409 | 1/1985 | Laird | 297/440 |
| 4,561,137 | 12/1985 | Smitherman et al. | 297/440 X |
| 4,580,836 | 4/1986 | Verney | 297/443 X |
| 4,580,839 | 4/1986 | Hatte | 297/440 X |
| 4,621,381 | 11/1986 | Schramek | 297/440 X |

FOREIGN PATENT DOCUMENTS

| | | | |
|---|---|---|---|
| 220199 | 12/1959 | Australia | 297/283 |
| 7406874 | 11/1975 | Netherlands | 297/440 |
| 920643 | 3/1963 | United Kingdom | 297/218 |

*Primary Examiner*—Kenneth J. Dorner
*Assistant Examiner*—José V. Chen
*Attorney, Agent, or Firm*—Silverman, Cass, Singer & Winburn, Ltd.

[57] ABSTRACT

A seating unit having removable and reversible cushion members is provided. Each cushion member is slidably mounted to a seat frame. The rear portion of the seat cushion member engages the bottom portion of the corresponding back cushion member, thereby locking them together. One of the cushion members is also locked to the seat frame.

13 Claims, 5 Drawing Sheets

SEAT WITH REMOVABLE CUSHIONS

BACKGROUND OF THE INVENTION

1. Field of the Invention

The field of the invention relates to seating units such as chairs or sofas having removable and/or reversible cushions.

2. Brief Description of the Prior Art

Furniture employed in institutional environments is often subject to abuse. It is accordingly necessary to not only insure that such furniture is of sturdy construction, but also that it may easily be cleaned or repaired. There are several seating units in use today which allow the seat and back cushions, and frames therefor, to be removed. Such cushions may be reversible to allow either side thereof to be used in case one side becomes damaged or soiled. U.S. Pat. Nos. 2,853,125, 4,395,071, 4,488,755 and 4,492,409 discloses seating units having the above-described features.

SUMMARY OF THE INVENTION

A seating unit is provided which includes a frame, a plurality of support members mounted to the frame, seat and back cushion members slidably secured to the support members, and means for securing the seat and back cushions to each other. In a preferred embodiment of the invention, one of the cushion members is provided with a pin extending therefrom while the other such member includes an eyelet. When the cushion members are positioned upon the seat frame, the pin extends through the eyelet, thereby securing the cushion members to each other. A set screw may be positioned within the seat frame for engaging the pin once the cushion members are in place. The pin preferably includes a notch for receiving the end of the set screw.

DETAILED DESCRIPTION OF THE INVENTION

A seating unit is provided having removable and reversible cushion members. The unit may take the form of a chair 10 as shown in FIG. 1, but the principles of the invention would be applicable to other articles of furniture as well.

Figure 2:
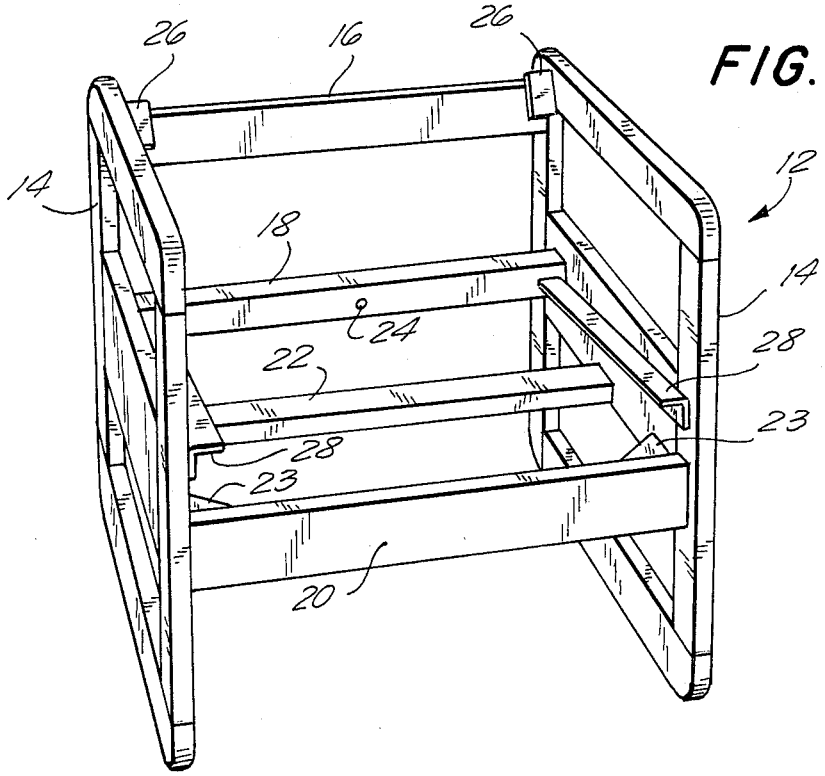
FIG. 2 is a front perspective view of a chair frame in accordance with the invention.

The chair 10 includes a wood frame 12 having opposing arm/leg assemblies 14, upper and lower rear cross members 16,18, a front cross member 20, and a seat support rail 22. All of the cross members are secured to the arm/leg assemblies as shown in FIG. 2. Corner blocks 23 are secured to each end of the front cross member and the arm/leg assemblies. The lower rear cross member 18 includes a cylindrical passage or socket 24 extending partially therethrough. A first pair of opposing, substantially parallel angle iron supports 26 is bolted to the upper, rear portions of the arm/leg assemblies. A second pair of opposing, substantially parallel angle iron supports 28 is bolted to the arm/leg assemblies. Each support 28 extends as far back as the lower rear cross member 18. The first pair of angle iron supports leans slightly rearwardly with respect to the chair frame, but otherwise extend generally vertically. The second pair of angle iron supports is substantially horizontal.

Figure 1:
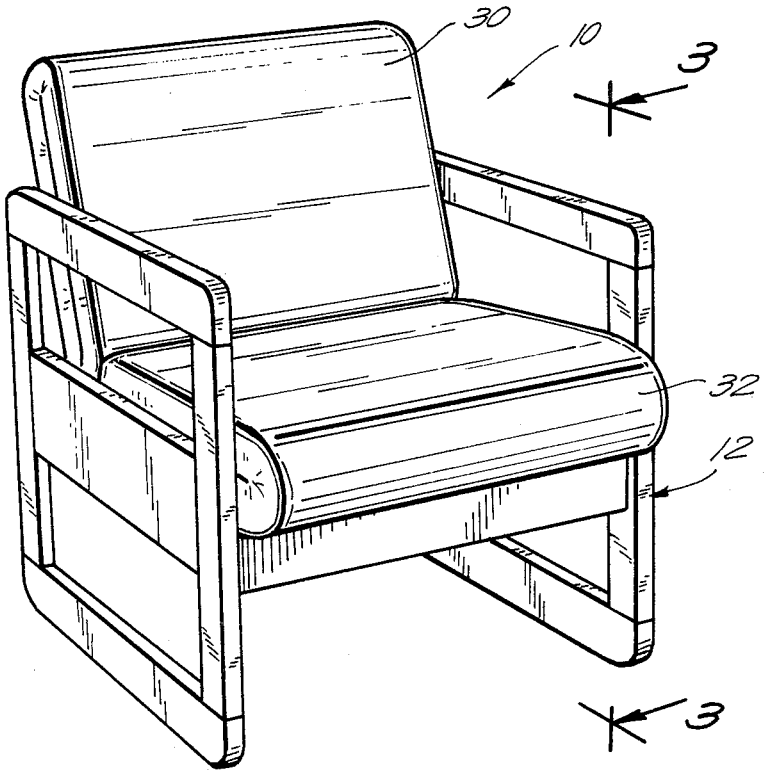
FIG. 1 is a front perspective view of a chair in accordance with the invention.
Figure 3:
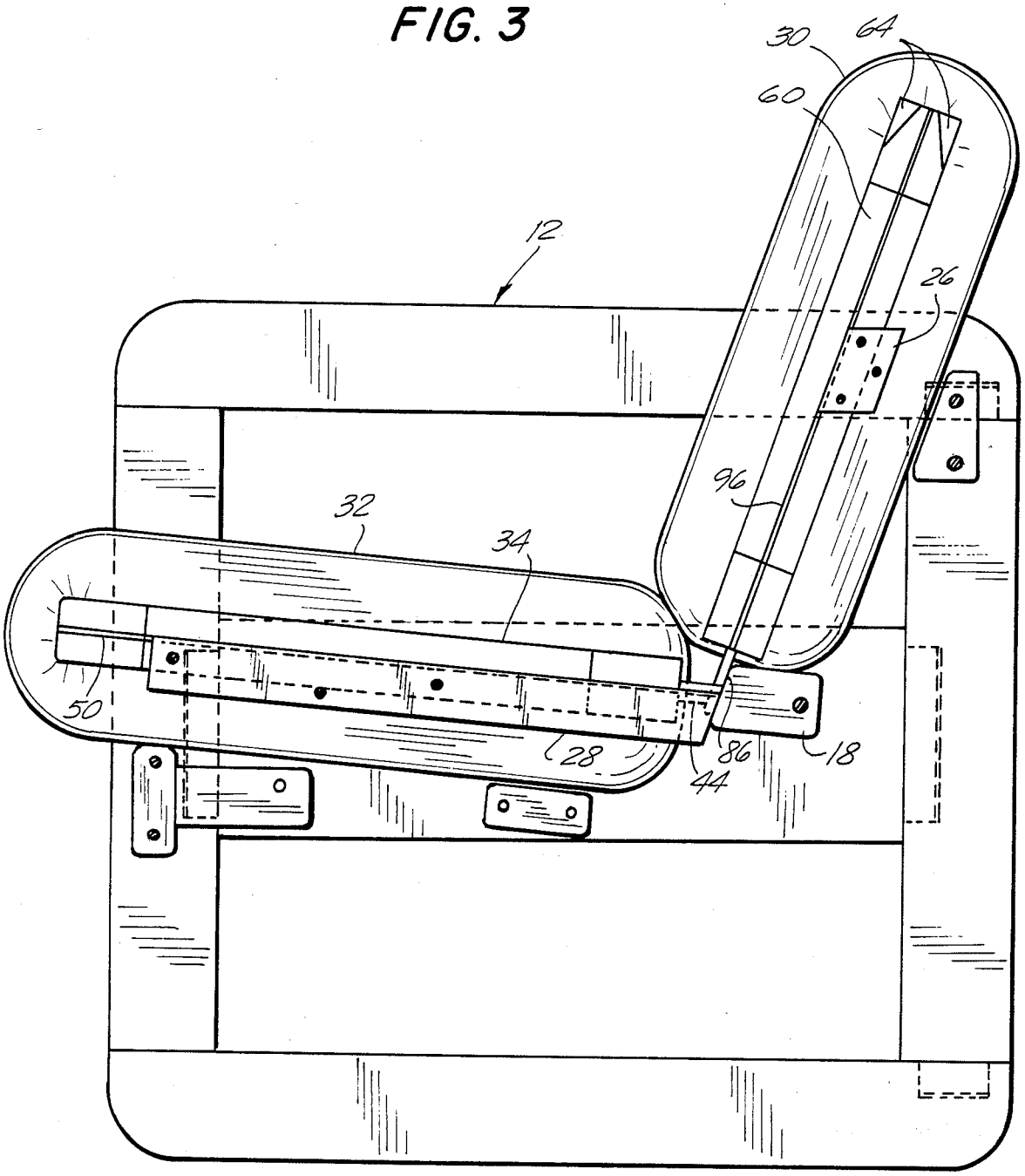
FIG. 3 is a sectional view taken along the plane of line 3—3 in FIG. 1.
Figure 5:
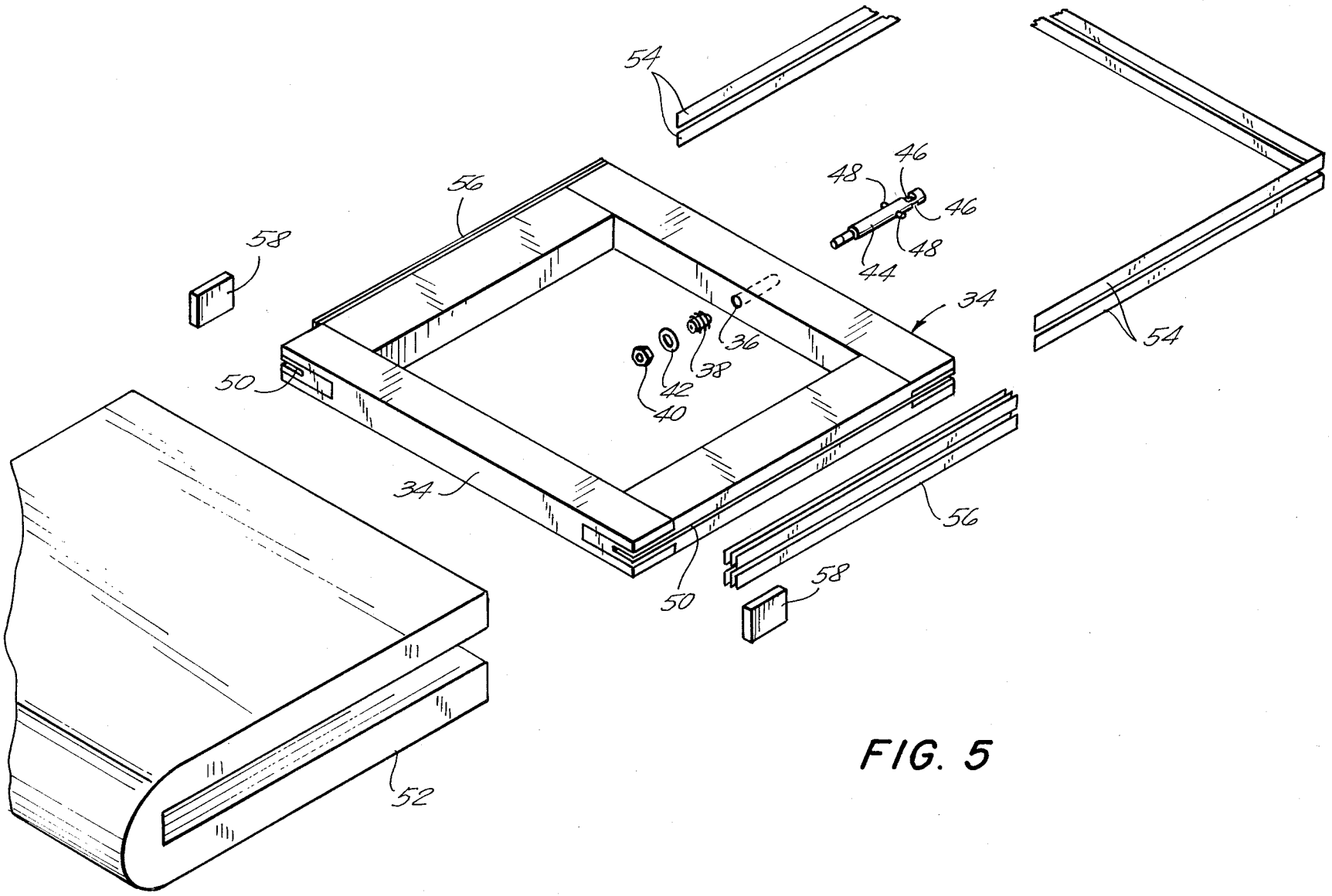
FIG. 5 is an exploded, perspective view of a seat cushion member in accordance with the invention.
Figure 6:
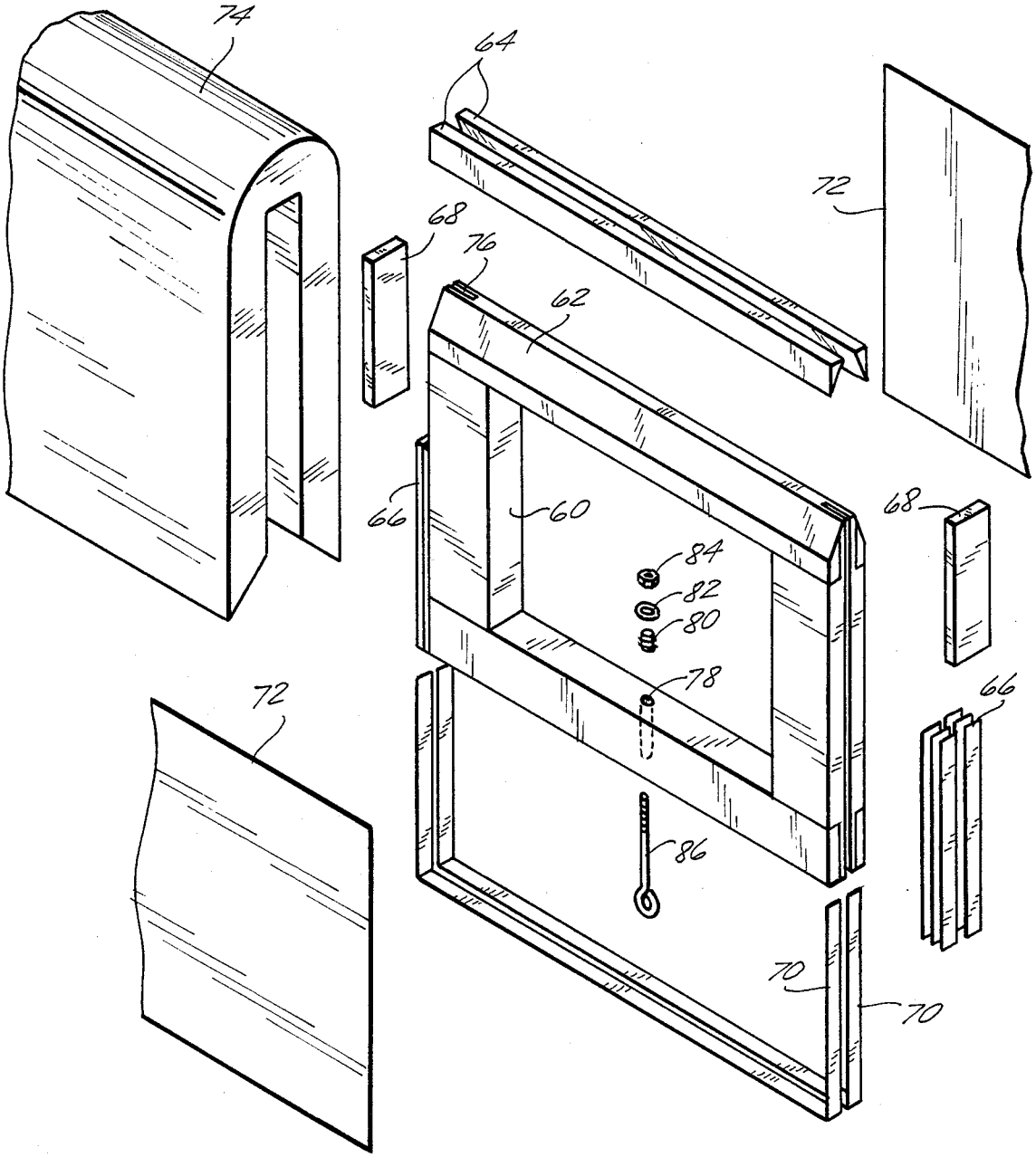
FIG. 6 is an exploded, perspective view of a back cushion member in accordance with the invention.

As shown in FIGS. 1 and 3, a back cushion member 30 is mounted to the first pair of angle iron supports 26 while a seat cushion member 32 is mounted to the second pair of angle iron supports. Referring to FIG. 5, the seat cushion member includes a rectangular frame 34. A horizontal opening 36 extends through the rear portion of the frame and an internally threaded insert 38 is positioned witin this opening. A pin 44 having a threaded end is positioned partially within the insert 38 and secured by the use of a flat washer 42 and hex nut 40. The pin 44 includes a pair of notches 46 near one end thereof and a pair of projections 48 extending normally therefrom in opposite directions. The portion of the pin including the notches and projections extends outside the opening 36 and rearwardly of the frame 34.

Each longitudinal side of the seat cushion frame 34 includes a slot 50 running the entire length thereof. The slots allow the seat cushion member 32 to be slidably mounted to the second pair of angle iron supports 28. An elastic web (not shown) or other suitable support member is affixed to each of the top and bottom surfaces of the seat cushion frame 34. The frame 34 and elastic webs are encased by a seat foam panel 52. A cover (not shown) may later be applied to the assembly. The cover is secured to the frame 34 by means of a hook and loop fastener arrangement. A pair of "hook" tapes 54 are affixed to the edges of the frame to allow a cover having a corresponding "loop" area to be secured thereto. If desired, two sets of resilient strips 56 and a pair of foam pieces 58 may be adhered to the frame prior to application of the tape 54.

The back cushion member 30 includes a substantially rectangular wood frame 60 having a beveled top end 62. A pair of wedge-shaped foam pieces 64 are secured to this top end 62. Two sets of resilient strips 66 and a pair of foam pieces 68 may be attached to the sides of the frame if extra padding is desired. A pair of "hook" tapes 70, similar to those shown in FIG. 5, allow a cover (not shown) having corresponding loop fasteners to be secured to the frame 60. A foam panel 74 is mounted to the frame and is enveloped by the cover. Each longitudinal side of the frame 60 includes a slot 76 running the entire length thereof. These slots allow the back cushion member 30 to be slidably mounted to the first pair of angle iron supports 26.

The bottom end of the seat back frame 60 includes a cylindrical bore 78 which runs substantially vertically with respect to the seat cushion member 32. An internally threaded insert 80 is positioned within the bore. An eyelet 86 having a threaded end is positioned partially within the insert and secured in position by a flat washer 82 and hex nut 84.

Figure 4:
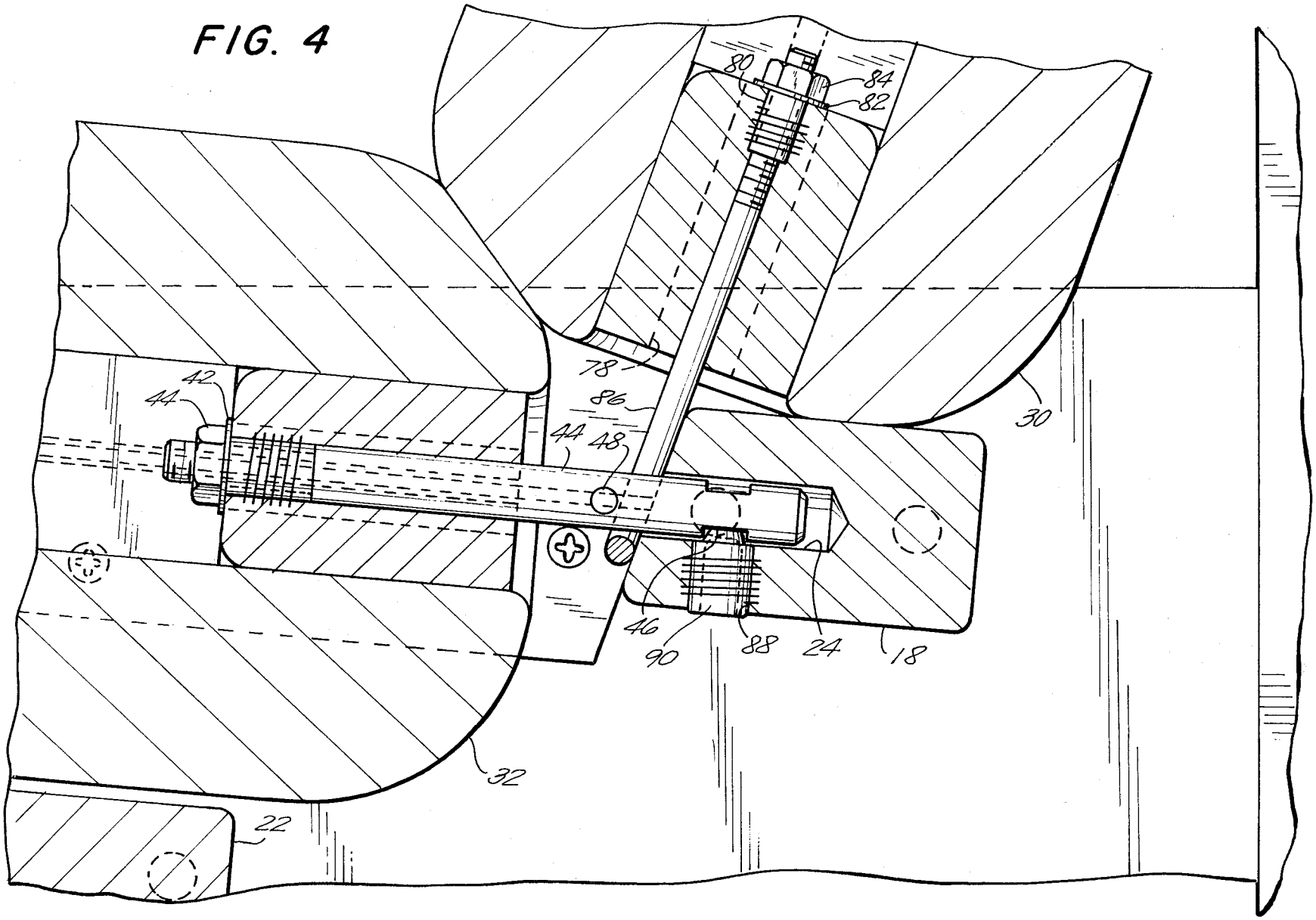
FIG. 4 is an enlarged, fragmentary sectional view illustrating the interlocking of seat and back cushion members of a chair in accordance with the invention.

FIGS. 3 and 4 are illustrative of the manner in which the back and seat cushion members 30,32 are mounted to the chair frame 12 and interlocked with each other. The unit is assembled by first mounting the back cushion member to the frame 12. This is accomplished by positioning the bottom end thereof above the angle iron supports 26 so that the supports are aligned with the slots 76 within the frame 60. The back cushion member 30 is then moved to the position shown in FIG. 3. In this position, the opening within the eyelet 86 is aligned with the opening of passage 24.

The seat cushion member 32 is then mounted to the frame 12 by moving the slots 50 into engagement with the second pair of angle iron supports 28. As it slides rearwardly along the supports, the pin 44 extending therefrom passes through the opening in the eyelet 86 and into the substantially horizontal passage 24. The pin projections 48 control the distance the pin may travel within this passage and insure that one of the notches 46 is aligned with a second passage or bore 88 in cross member 18. A set screw 90 within the passage is turned to engage the notch 46, thereby locking the seat cushion member 32 in position. The back cushion member 30 is also locked in position at this time due to the pin's engagement of the eyelet.

To disassemble the chair 10, the above procedure is reversed. The set screw may be recessed within passage 88 and require an Allen wrench for turning to discourage unauthorized persons from removing cushion members. Once removed, either cushion member may be replaced or simply reversed in the event only one of the surfaces thereof has become soiled. The symmetrical construction of these members allows them to face in either of two directions when engaged by the support members 26,28.

What is claimed is:

1. In a seating unit including back and front ends and having a support frame providing a pair of opposing arm/leg assemblies having upper ends, means for cross-bracing said arm and leg assemblies connected between said assemblies including a first cross-bracing member connected between said assemblies adjacent the back end of the unit and the upper ends of the assemblies, each assembly having an elongate seat support member secured thereto and facing inwardly one toward the other, a second cross-bracing member secured between said assemblies adjacent the back end of the unit and aligned with said seat support members, said second cross-bracing member having a transverse socket intermediate the ends thereof and opening to a face thereof, a seat cushion including a cushion support frame attached thereto secured on said seat support members and having front and rear ends, a backrest cushion including a cushion support frame attached thereto having upper and lower ends, said cushion and backrest support frames each having a fastener pin secured thereto and protruding toward the second cross-bracing member, the protruding parts of said fastener pins being secured one to the other, one of said pins protruding from one of said cushion support frames being engaged through said socket whereby to prevent displacement of the seat and backrest cushions one relative to the other.

2. The seating unit as defined in claim 1 wherein said second cross-bracing member is provided with a passageway opening at one end thereof into said socket.

3. The seating unit as defined in claim 2 wherein said one pin is secured in said socket by a fastener engaged in said passageway and intercepting said one pin.

4. The seating unit as defined in claim 3 wherein said pin is provided with at least one notch to be engaged by said fastener.

5. The seating unit as defined in claim 1 wherein said socket opens toward said front end of said unit, said seat cushion support frame fastener pin being secured in said socket.

6. The seating unit as defined in claim 5 wherein said backrest cushion support frame fastener pin is provided with an eyelet, said seat cushion support frame fastener pin being matingly engaged with said eyelet.

7. The seating unit as defined in claim 6 wherein said seat cushion support frame fastener pin is provided with at least one projection extending transversely therefrom and located thereon so that said eyelet engaged with said pin is positioned between said projection and said second cross-bracing member.

8. The seating unit as defined in claim 1 wherein said seat cushion frame includes a pair of slots on either side thereof removably engaged with said seat support members.

9. The seating unit as defined in claim 8 wherein said seat support members are angle iron members.

10. In a seating unit including back and front ends and having a support frame providing a pair of opposing arm/leg assemblies having upper ends, means for cross-bracing said arm and leg assemblies connected between said assemblies including a first cross-bracing member connected between said assemblies adjacent the back end of the unit and the upper ends of the assemblies, each assembly having an elongate seat support member secured thereto and facing inwardly one toward the other, a second cross-bracing member secured betwen said assemblies adjacent the back end of the unit and aligned with said seat support members, said second cross-bracing member having a transverse socket intermediate the ends thereof and opening to a face thereof, a seat cushion including a cushion support frame attached thereto secured on said seat support members and having front and rear ends, said seat cushion frame having a slot in each side thereof to slidably engage said seat support members, a fastener pin secured at a first end thereof to said rear end of said seat cushion frame and protruding toward the second cross-bracing member to engage said socket at a second end of said fastener pin, said second cross-bracing member having a passageway opening at one end thereto into said socket and a fastener means engaged in said passageway to intercept said pin and secure it to said cross-bracing member.

11. The seating unit as defined in claim 10 wherein said pin has at least one notch which is engaged by said fastener means.

12. The seating unit as defined in claim 10 wherein said fastener means is a set screw threadably engaged in said passageway.

13. The seating unit as defined in claim 10 wherein said support member use a pair of angle iron members.

* * * * *